United States Patent [19]

Fujita

[11] 3,952,333

[45] Apr. 27, 1976

[54] GOLF GLOVE

[76] Inventor: Isamu Fujita, 6-1, 8-chome, Arakawa, Arakawa, Tokyo, Japan

[22] Filed: Feb. 13, 1975

[21] Appl. No.: 549,670

[30] Foreign Application Priority Data

Nov. 27, 1974 Japan ..... 49-142670[U]

[52] U.S. Cl. ..... 2/161 A

[51] Int. Cl.[2] ..... A41D 19/00

[58] Field of Search ..... 2/161 R, 161 A, 162, 2/159

[56] References Cited

UNITED STATES PATENTS

| | | | |
|---|---|---|---|
| 3,229,307 | 1/1966 | Jamison | 2/162 |
| 3,255,462 | 6/1966 | Antonious | 2/161 A |
| 3,430,265 | 3/1969 | Mazza | 2/162 |
| 3,504,379 | 4/1970 | Glick | 2/161 A |
| 3,588,917 | 6/1971 | Antonious | 2/161 A |
| 3,600,715 | 8/1971 | Perrella | 2/162 |

*Primary Examiner*—G. V. Larkin

*Attorney, Agent, or Firm*—Connolly and Hutz

[57] ABSTRACT

Golf glove comprises body including front palm, back and finger portions with wrist encircling bottom edge. Notch in back portion of body extends from bottom edge toward finger portion. Band material is secured to wrist encircling bottom edge and band terminates at boundary of notch. Band extends along bottom of front body portion slightly below palm bulge thereof, and each end of band extends to back body portion at oblique angle in direction toward finger portion so that projected ends of band cross each other at back body portion. Fastener members are secured to opposite sides of notch for closing it.

8 Claims, 10 Drawing Figures

GOLF GLOVE

BACKGROUND OF THE INVENTION

A golf glove, when it is being worn on the hand, should fit the bulge at the bottom of the palm and fit the palm exactly without causing any wrinkle in the palm portion. To meet this requirement, golf gloves have heretofore been designed such that a notch is provided extending from the bottom edge of the glove on the back side of the hand. On one side of the notch a fastener tongue is provided in transverse direction, while on the other side of the notch a fastener piece is provided. The fastener tongue, when pulled in transverse direction, tightly engages the fastener piece (Conventional Example 1).

There are other golf gloves designed such that a notch is provided directly vertical from the bottom edge of the glove on the back side of the hand. On one side of the notch a fastener tongue is provided in transverse direction, while on the other side of the notch a fastener piece is fitted. The fastener tongue, when pulled in transverse direction, tightly engages the fastener piece. Further, an elastic band is fitted transversely along the bottom edge of the glove and the two ends of the band are held together by means of a snap-button (Conventional Example 2).

There is yet another golf glove designed such that a shallow V-shaped notch is cut at the bottom edge of the back side of the glove. An elastic band is sewed transversely to one part on the inside of the lower portion of the glove. And in the same way as in Conventional Example 2, a fastener tongue is provided in a transverse direction, and when pulled in a transverse direction, the tongue tightly engages a fastener piece (Conventional Example 3).

Thus in all of these golf gloves a pull is made in a transverse direction and the notch in the back of the glove is invariably cut upward at right angle to the rear bottom edge of the glove for convenience of transverse pull. The portion of the hand from the front and back of the wrist to the palm and back of palm has the shape of an inverted cone with its point flattened in the longitudinal direction of the hand and therefore the circumferential length of a transverse line around this part varies widely according to the vertical position of said line along the long axis of the hand. So, when tightened in a transverse direction, a glove cannot make a snug fit with the hand. Moreover, since there is no pull acting in a direction perpendicular to the transverse direction, the palm portion of the glove is liable to become wrinkled. Moreover, with a compressive force acting at the midpoint of hand from both sides a pinch is felt and this feel of pinch is intensified by the structure of the hand which expands in transverse direction when it grips the club. When a band is to be fitted transversely, it is impossible to cut a deep V-shaped notch in the lower portion of the back of the glove; thus with the rear of the wrist pinched by the glove, a cocking of the hand, which necessitates a subtle feel of the hand, cannot be made satisfactorily.

BRIEF SUMMARY OF THE INVENTION

The object of the present invention is to provide golf gloves characterized in that a band is sewed to the body of the glove in such manner that it can closely fit the flat portion of the hand extending from the front and back of the wrist to the palm and back of palm. The band, when pulled, makes a perfect fit with the bulge at the bottom of palm and the wrist without causing wrinkles in the palm portion.

Another object of the present invention is to provide golf gloves characterized in that a notch is cut in the back side of the glove and extensions of the band run slantingly upward right and left, crossing each other, so that no transverse pinch occurs in the hand, and any transverse expansion of the hand when gripping the club can be smoothly absorbed.

Another object of the present invention is to provide golf gloves characterized in that a band having elasticity is used with the effect of assuring a close fit of glove to the hand and wrist and eliminating wrinkles in the palm portion.

Another object of the present invention is to provide golf gloves characterized in that the notch in the back of the glove is cut towards the fingers approximately perpendicular to the direction of the band fitted on the side of the notch where the fastener tongue is fitted thereby making the pull of the band more effective.

Another object of the present invention is to provide golf gloves characterized in that above the band on the fastener tongue-fitting side an additional band is provided slantwise and substantially parallel to the band thereby effectively assuring the fit of the glove with the hand and the removal of wrinkles from the palm portion.

Another object of the present invention is to provide golf gloves characterized in that the bottom edge of the glove is constituted by the bottom edge of a band slantingly crossing the back of the hand and a thus naturally formed V-shaped notch makes it possible to cock the hand well without pinching the rear of the wrist.

Still another object of the present invention is to provide golf gloves which substantially meet all the above objects by one means of sewing to the body of the glove a band which can closely fit the flat inverted frusto cone portion of the hand.

BRIEF DESCRIPTION OF THE DRAWINGS

The objects and advantages of the present invention will become more apparent from the following detailed description referring to the attached drawings in which.

DETAILED DESCRIPTION OF THE INVENTION

FIGS. 4 to 10 illustrate a golf glove of one embodiment of the present invention. In these figures a left hand glove is shown and since the right hand one is merely a reverse of the left hand one shown, the following description concerns only the left hand one.

Figure 3:
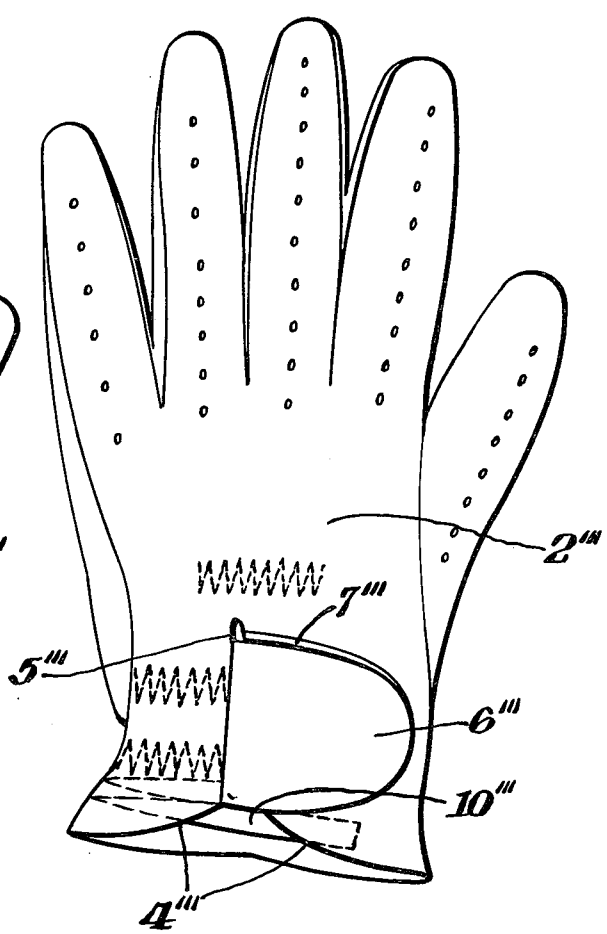
FIG. 3 is a rear view of the conventional golf glove of Example 3.
Figure 2:
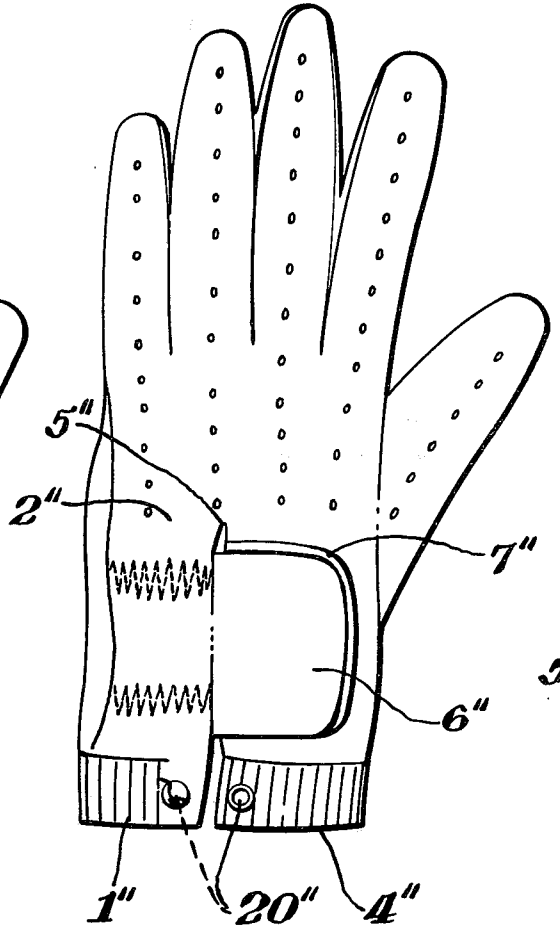
FIG. 2 is a rear view of the conventional golf glove of Example 2.
Figure 1:
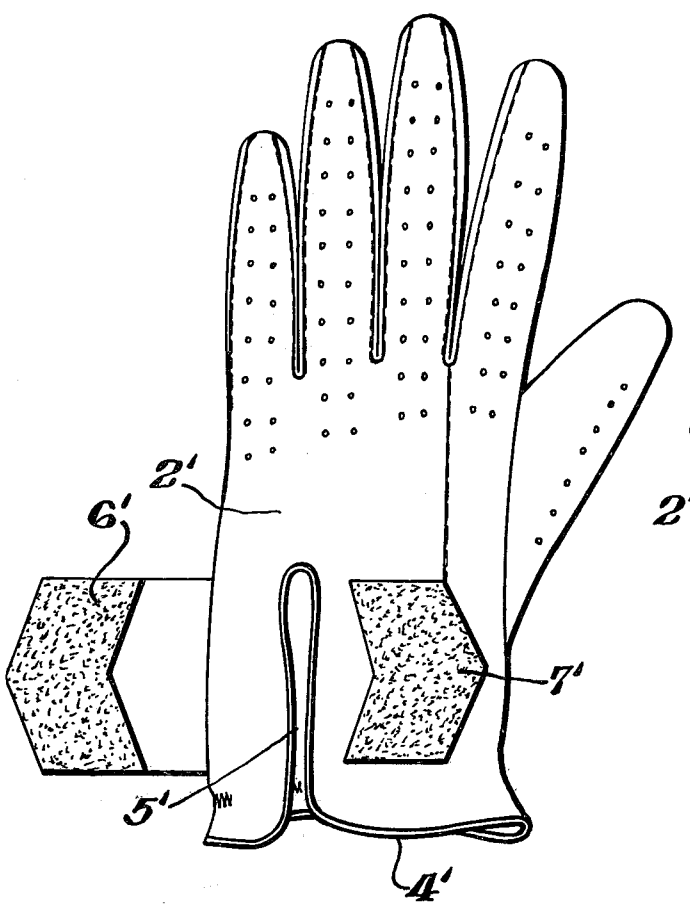
FIG. 1 is a rear view of the conventional golf glove of Example 1.
Figure 5:
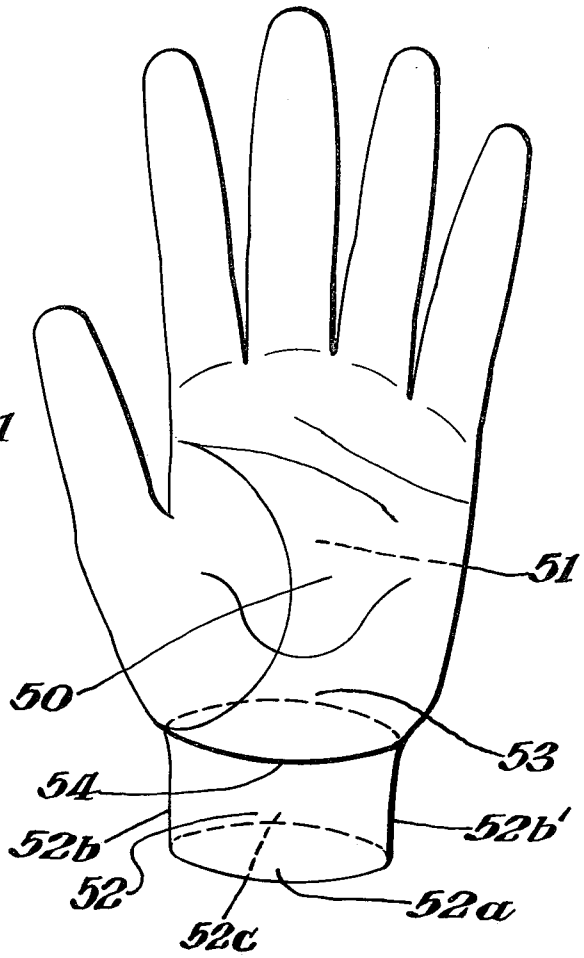
FIG. 5 is a reference diagram explaining the symbols in the hand to be used in the description hereafter.
Figure 4:
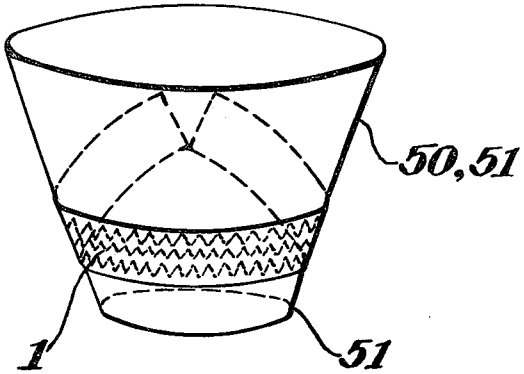
FIG. 4 is a reference diagram of the band as attached to the hand, which explains the working principle of the invention.
Figure 7:
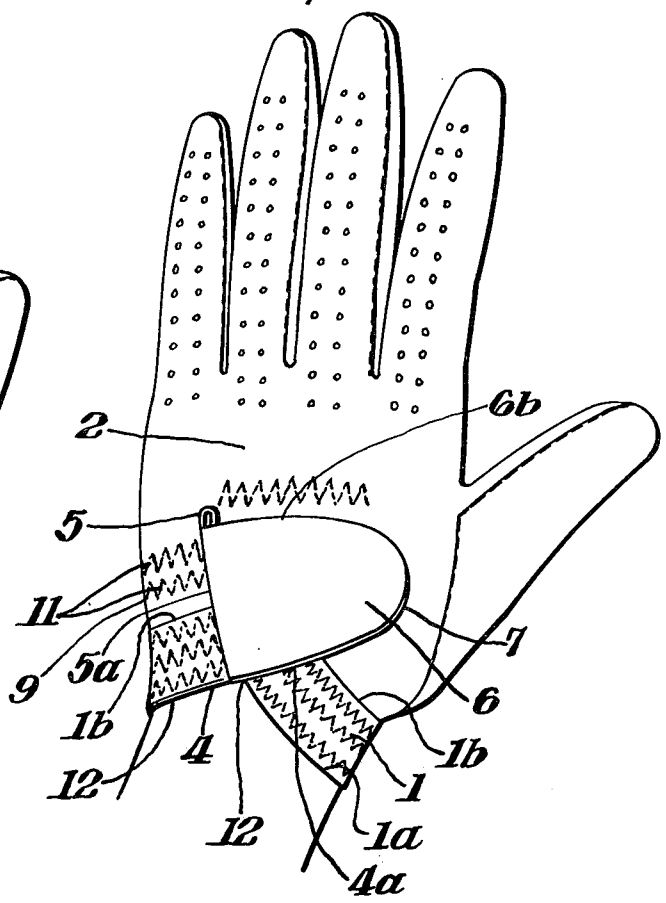
FIG. 7 is a rear view of the golf glove of the present invention shown fitted to the hand with the fastener closed.
Figure 6:
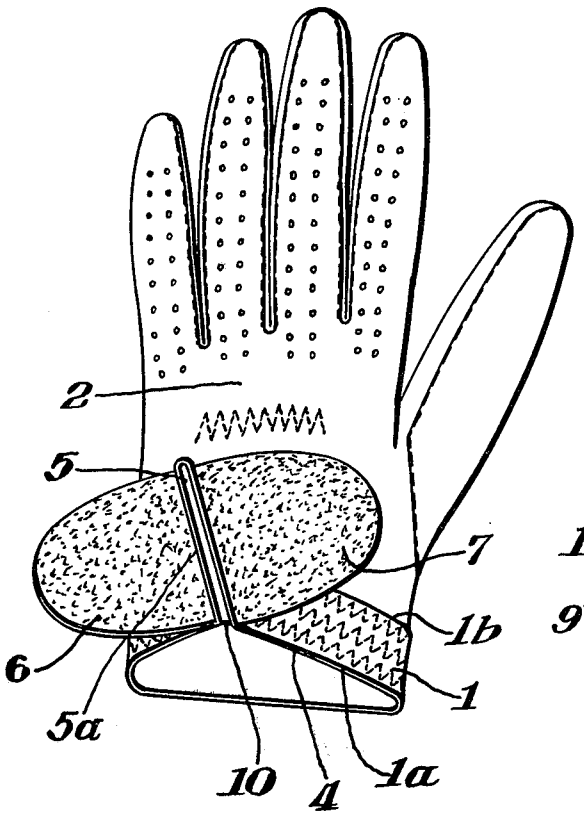
FIG. 6 is a rear view of the golf glove of the present invention with the fastener open.
Figure 9:
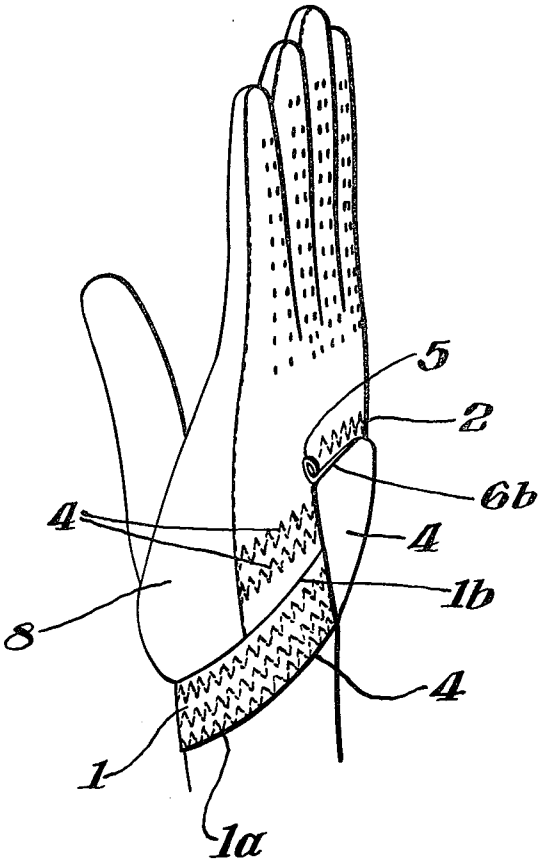
FIG. 9 is a left side view of the glove of FIGS. 6 and 7.
Figure 8:
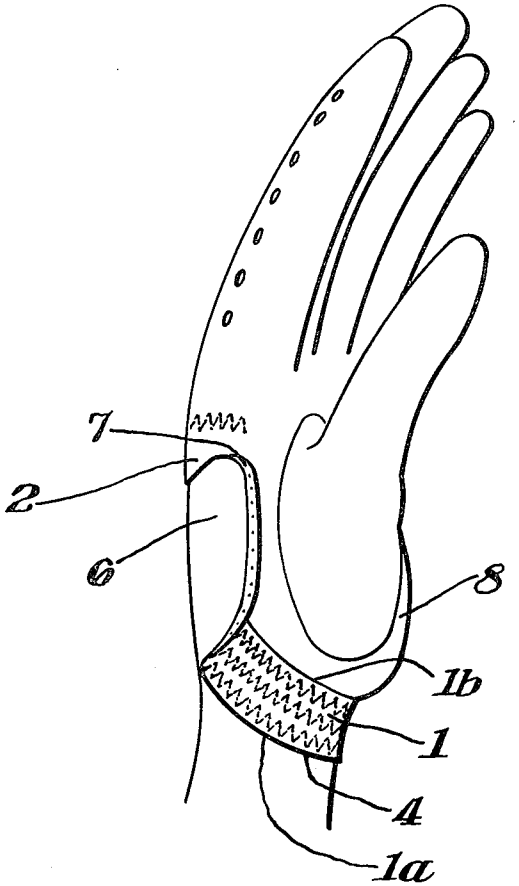
FIG. 8 is a right side view of the glove of FIGS. 6 and 7.
Figure 10:
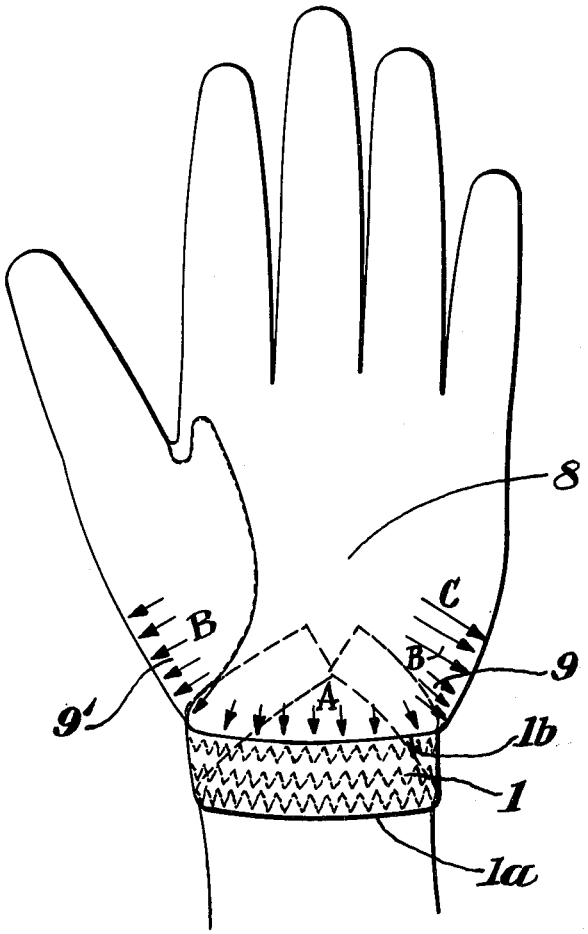
FIG. 10 is a front view of the palm side of the glove of FIGS. 6 and 7.

As shown in FIG. 4 the human hand is constructed such that generally the portion of it extending from the palm 50 and back of palm 51 to the wrist 52 is formed like an inverted frusto cone slightly flattened in the longitudinal direction (hereafter, for simplicity, to be called a flat frusto cone). Therefore a band transversely attached and pulled will not be effective for smoothly fitting the glove to the palm 50 and the bulge 53 at the bottom of the palm without causing wrinkles. The band should be pulled, as shown in FIG. 4, with the ends of the band crossed slantingly to effect a close fit to the flat inverted frusto cone of the hand.

This is the basic principle of the present invention, which is fundamentally different from the conventional principle of tightening the band in a transverse direction with no regard to the structure of the hand.

First, in accordance with the above principle, when the band 1 is fitted over the flat inverted frusto cone, it is so arranged that the crossing may take place on the back 2 of hand in the glove. Next a notch 5 is cut in the back 2 of the glove toward the fingers in a direction approximately perpendicular to the band 1, running slantwise from the bottom edge 4 of the glove. The notch 5 thus cuts straight upwards from the bottom edge 4 makes it possible to pull the band 1 without unreasonable force.

The band 1 runs along the boundary between the bulge 53 at bottom of the palm and the wrist 52, around the front of the wrist 52*a*, reaching both sides 52*b*, 52*b'* of the wrist. The two extended ends of the band crossing each other run up right and left over the surface of the back of the palm 51 from both sides 52*b*, 52*b'* of the wrist, and the band is sewed to the body 3 of the glove after almost encircling the front 52*a* of wrist and the back of the palm 51, both ends of it terminating in the vicinity of said notch 5.

One end of a fastener tongue 6 is fitted at one edge 5*a* of the notch 5. The width of the fastener tongue 6 is about equal to the length of the notch 5 and desirably larger than the width of the band 1. As the fastener tongue 6 serves to fix the band 1 in a stretched state, it is desirable that the tongue 6 be fitted nearly in the same direction as the band 1 which is sewed to the side of the notch 5. At the opposite edge of the notch 5 is fitted a fastener piece 7 at a spot where the fastener tongue 6 engages. The body 3 of glove can be stretched and fixed by engaging the fastener tongue 6 with the fastener piece 7. The fastener means consists of a cloth with loops and a cloth with a hook-like elastic needles.

Across the back 2 of the hand the band 1 runs right and left upward and the bottom edge of the band 1 constitutes the bottom edge of the body 3 of the glove. Therefore when the glove is worn on the hand, the rear 52*c* of the wrist is widely exposed.

When in a glove thus constituted the band 1 is pulled, the band portion of the body 3 of the glove and its vicinity where the tension of the band 1 is transmitted can perfectly fit the front 52*a* of the wrist, both sides 52*b*, 52*b'* of the wrist and the bulge 53 at the bottom of the palm, producing an appropriate tension. Thereby, since the bulge 53 at the bottom of the palm is convexly curved, the tension of the band 1 at the front 52*a* of the wrist produces a force which pulls the palm 8 of the glove downward (pull A in FIG. 10). At the same time, the vicinity of the band 1 in the body 3 of the glove expands in the band direction and contracts in a direction perpendicular to it thereby increasing the downward pull of the palm 8. A pull also develops at the bottom parts 9, 9' of the glove where the tension of the band 1 is transmitted (pulls B, B' in FIG. 10). These pulls have a remarkable effect in eliminating wrinkles from the palm 8. Since these pulls B, B' act radiating from the palm 8 as the center, wrinkles can be prevented from occurring in all directions.

On the other hand, a V-shaped notch 10 formed in the back 2 of the glove by the band 1 which runs right and left slantingly upward widely bares the rear 52*c* of the wrist thereby making it possible to lightly cock the hand without pinching the rear 52*c* of the wrist. When a golfer grips the club, his hand expands in a transverse direction, but a tightening of the band 1 gives tension to the front 52*a* of wrist and the bulge 53 at the bottom of the palm without strongly stretching transversely the palm 50 and the back 51. Thus the wearer can freely grip a golf-club without any feel of pinch.

The band 1 described above does not always have to be one of high elasticity, but a still better effect will be obtained if it is a highly elastic one for example, one of rubber. The flat inverted frusto cone extending from the palm 50 and back 51 of palm to the wrist 52 has not a regular form, but is locally distorted. A band of rubber will be able to follow such an irregular form. Use of a band made of rubber has another merit in that it equalizes the stress developed in the body 3 of the glove.

The notch 5 in the back 2 of the glove has only to be cut running upward from the bottom edge 4 of the glove. Particularly when the notch 5 is cut in a direction approximately perpendicular to the direction of the end of the band 1 sewed to the side of the fitted fastener tongue 6, it will be natural and best from the standpoint of application of a pull to the band 1.

In the back 2 of the glove the width of the fastener tongue 6 is made larger than the width of the band 1. The bottom edge 6*a* of the fastener tongue 6 is fitted nearly meeting the bottom edge 1*a* of the band 1. An additional elastic band 11 is provided running upward slantingly parallel to the band 1 in the portion between top edge 6*b* of the fastener tongue 6 and the top edge 1*b* of the band, which extends from the fixture of the fastener tongue 6 to the bottom side 9 of glove. The pull acting on the fastener tongue 6 is effectively transmitted over the additional band 11 to give a pull to the bottom side 9 of the glove and a wrinkle-correcting pull (pull C in FIG. 10) to the palm 8 of the glove. Thus the effect of the band 1 is further enhanced.

The various effects of the present invention described above can substantially be gained at the same time by one means of fitting the band 1 closely over the flat inverted frusto cone of the hand. Namely, elimination of wrinkles from the palm 8; close fitting of the bottom edge 4 of the glove to the wrist 52 and the bulge 53 at the bottom of the palm; tightening of the bottom edge 4 of glove to prevent the glove from slipping off; and provision in the body 3 of the glove of a V-shaped notch 10 which bares the rear portion 52*a* of the wrist to facilitate a cocking of the hand. All of these effects are not attained separately by different means, but substantially attained by a single means of a band 1 which is fitted following the contour of the hand.

What is claimed is:

1. A golf glove comprising a body including a front palm, back and finger portions, a wrist encircling bottom edge, a notch in the back portion of the body extending from the bottom edge toward the finger portion, a band secured to the wrist encircling bottom edge and terminating at the boundary of the notch, the band extending along the bottom of the front body portion slightly below the palm bulge thereof, each end of the band extending to the back body portion at an oblique angle in a direction toward the finger portion so that the projected ends of the band cross each other at the back body portion, and fastener members secured to opposite sides of the notch for closing it.

2. A golf glove as in claim 1 wherein the band is elastic.

3. A golf glove as in claim 1 wherein the fastener members include a fastener tongue secured to one side boundary of the notch and adapted to lockingly cooperate with the fastener member on the opposite side boundary of the notch.

4. A golf glove as in claim 3 wherein the fastener tongue has a width larger than the width of the band and wherein the bottom edge of the tongue is in substantial alignment with the bottom edge of the band.

5. A golf glove as in claim 4 wherein the band is elastic.

6. A golf glove as in claim 1 wherein the notch is V-shaped with the open end of the V at the bottom edge of the glove.

7. A golf glove as in claim 3 wherein the width of the fastener tongue is greater than the width of the band, and wherein the bottom edge of the fastener tongue substantially meets the bottom edge of the band.

8. A golf glove as in claim 7 including elastic material secured to the back portion of the glove extending away from the fastener tongue and parallel to the band.

* * * * *